US010364581B2

(12) United States Patent
Davis

(10) Patent No.: US 10,364,581 B2
(45) Date of Patent: Jul. 30, 2019

(54) MASONRY CORNER JIG

(71) Applicant: James L. Davis, Murphy, NC (US)

(72) Inventor: James L. Davis, Murphy, NC (US)

( * ) Notice: Subject to any disclaimer, the term of this patent is extended or adjusted under 35 U.S.C. 154(b) by 0 days.

(21) Appl. No.: 16/020,476

(22) Filed: Jun. 27, 2018

(65) Prior Publication Data

US 2019/0106892 A1 Apr. 11, 2019

Related U.S. Application Data

(60) Provisional application No. 62/525,444, filed on Jun. 27, 2017.

(51) Int. Cl.
*E04G 21/18* (2006.01)
*B28D 7/04* (2006.01)

(52) U.S. Cl.
CPC ..... *E04G 21/1841* (2013.01); *B28D 7/043* (2013.01)

(58) Field of Classification Search
CPC ... E04G 21/1841; E04G 21/164; E04G 21/22; E04G 21/1808; E04G 21/1816; E04G 21/1825; E04G 21/1833
See application file for complete search history.

(56) References Cited

U.S. PATENT DOCUMENTS 2,143,237 A * 1/1939 Byrnes ..... E04G 21/1808 33/409
3,348,312 A * 10/1967 Jones ..... E04G 21/1808 33/406
4,970,797 A * 11/1990 Sarasin ..... E04G 21/1808 33/404
2006/0059856 A1* 3/2006 Gilliland ..... E04G 21/1808 52/749.1
2012/0097808 A1* 4/2012 Ruonavaara ..... E04G 21/1808 248/125.3

* cited by examiner

*Primary Examiner* — Christine T Cajilig
(74) *Attorney, Agent, or Firm* — The Van Winkle Law Firm; William G. Heedy

(57) ABSTRACT

An a masonry corner jig includes a main elongate body including first and second portions extending from a midpoint, the main elongate body forming a plurality of apertures extending a length of the main elongate body at the midpoint; first and second legs; first and second L-shaped plates each defining a central leg bracket; an adjustable grade stake; a metal plate defining a base; first and second legs each including a leg hinge, a leg rod, an adjusting rod, the adjusting rod forming hole through the center of the adjusting rod, an adjusting pin that is sized and configured for engaged passage through the hole of the adjusting rod, a cylinder defining an ankle rod, and a foot plate that is sized and configured for attachment to the first end of the ankle rod.

3 Claims, 12 Drawing Sheets

MASONRY CORNER JIG

RELATED APPLICATION

This application claims priority to and incorporates entirely by reference U.S. Provisional Application No. 62/525,444 filed on Jun. 27, 2017.

FIELD OF THE INVENTION

This invention relates to jigs for woodworking and, more particularly, to a masonry corner jig.

BACKGROUND OF THE INVENTION

Woodworkers and other varieties of handymen rely on jigs, the primary purpose of which is to provide repeatability, accuracy, and interchangeability in the manufacturing of products. There are a large variety of types of jigs as they are often custom-tailored to do a specific job. There exists a need in the art for an improved masonry corner jig.

SUMMARY OF THE INVENTION

In accordance with one form of this invention there is provided a masonry corner jig including a main elongate body including first and second portions extending from a midpoint, the main elongate body forming a plurality of apertures extending a length of the main elongate body at the midpoint; first and second leg pegs each being sized and configured for selective attachment to the main elongate body on a respective one of the first and second portions; first and second L-shaped plates each defining a central leg bracket including a first surface and a second surface; the central leg bracket being sized and configured for selective attachment to the main elongate body; the central leg bracket including a curved plate extending from the second surface, the curved plate forming a hole extending the length of the curved plate; an adjustable grade stake sized and configured for engaged passage through the hole on each of the curved plates of the respective first and second central leg brackets; a metal plate defining a base, the base forming a body having a 90-degree cutout section wherein the point of the 90-degree cutout section is aligned with the center of the base; the base forming three holes along a perimeter zone of the base; a tube extending from the base and forming a channel sized for engaged receipt of the adjustable grade stake; first and second legs each including a leg hinge having a first end and a second end that is sized and configured for attachment to the leg peg; a leg rod having a first end and a second end that is sized and configured for attachment to the first end of the leg hinge; an adjusting rod having a first end and a second end that is sized and configured for attachment to the first end of the leg rod; the adjusting rod forming hole through the center of the adjusting rod; an adjusting pin that is sized and configured for engaged passage through the hole of the adjusting rod; a cylinder defining an ankle rod, the ankle rod having a first end and a second end that is sized and configured for attachment to the first end of the adjusting rod; and a foot plate that is sized and configured for attachment to the first end of the ankle rod.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the masonry corner jig of the present invention is shown and is generally indicated as (part A).

With reference to FIGS. 1-4, the main elongate body of the Masonry Corner Jig (part A) is 8'1" tall. It is bent horizontally on a 90-degree angle with each side 4" wide. On the inside of the body are vertical grooves that extend from the corner to the end of the plate. The grooves are spaced on 1" centers starting from the bottom of the body and end at the top of the body with the last groove being 1" from the top of the body. On the outside of the body, the lines are numbered counting by 4 on every 4th line. There are 20 bolt holes in the body of the Masonry Corner Jig. Each hole is beveled on the inside of the body so that a flat head bolt will flush with the inside of the body. The bolt holes are parallel to each other on each side of the corner. The bolt holes are located at 1½' from the corner and 4, 6, 9, 11, 47, and 49 inches from the bottom. Four of the holes are 3½ inches from the corner and 47 and 49 inches from the bottom. The remaining four holes are 2" from the corner and 93½ and 95½ from the bottom. There are rectangular holes through the corner of the body. They extend ½" from the corner and they extend from 2½" to 6", 7½" to 10", 11½" to 12½", 14½" to 16½", 17½" to 21½", 23½" to 25½", 26½" to 30½", 31½" to 33½", 34½" to 36½", 38½" to 40½", 41½" to 42½", 43½" to 45½", 47½" to 48½", 50½" to 52½", 53½" to 54½", 55½" to 57½", 59½" to 60½", 62½" to 64½", 65½" to 66½", 67½" to 69½", 71½" to 72½", 74½" to 76½", 77½" to 78½", 79½" to 81½", 83½" to 84½", 86½" to 88½", 89½" to 90½", 91½" to 93½", 95½" to 96½". On the outside of the body are two leveling vials.

Figure 1:
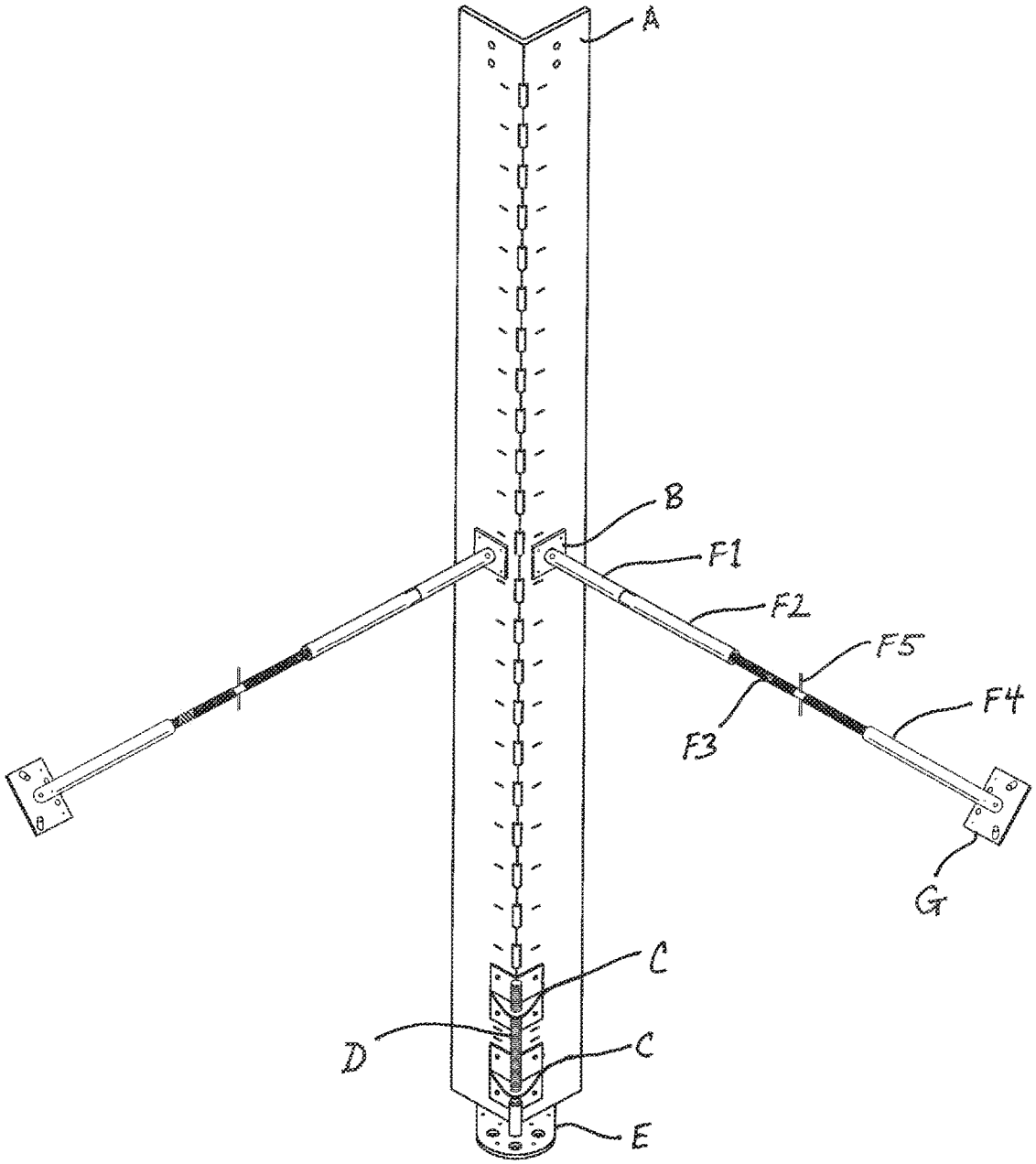
FIG. 1 is a perspective view of the masonry corner jig of the present invention.
Figure 2:
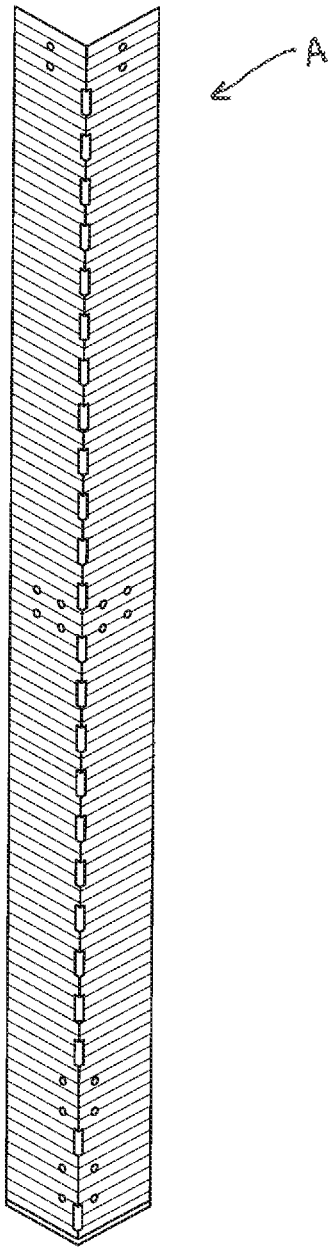
FIG. 2 is a perspective view illustrating the interior side of the main elongate body of the masonry corner jig of the present invention.
Figure 3:
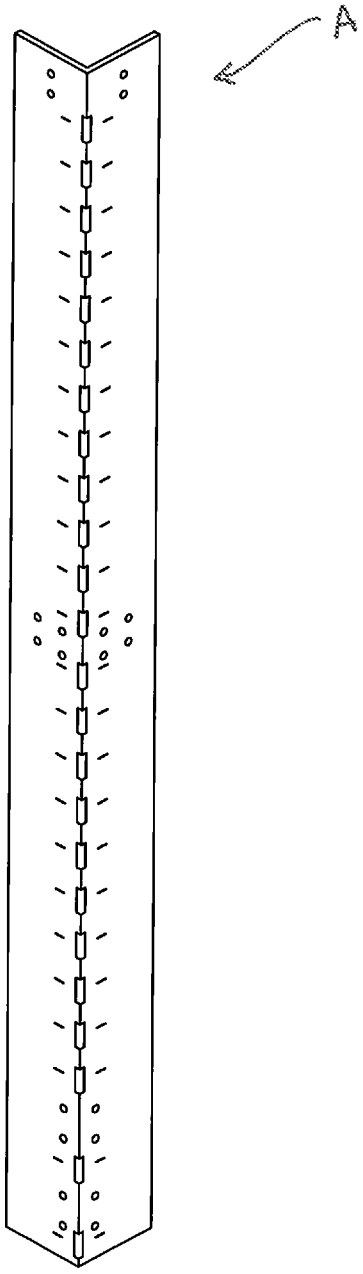
FIG. 3 is a perspective view illustrating the exterior side of the main elongate body of the masonry corner jig of the present invention.
Figure 4:
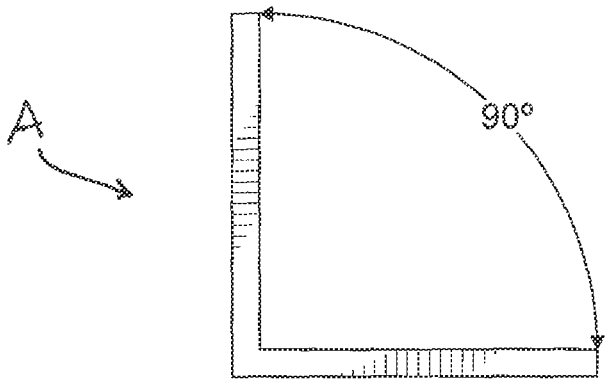
FIG. 4 is a top plan view illustrating the main elongate body of the masonry corner jig of the present invention.
Figure 5:
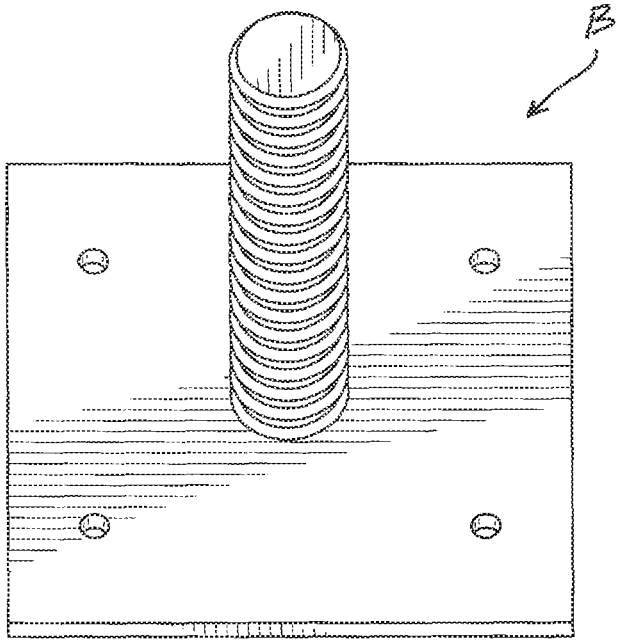
FIG. 5 is a perspective view illustrating the leg peg.
Figure 6:
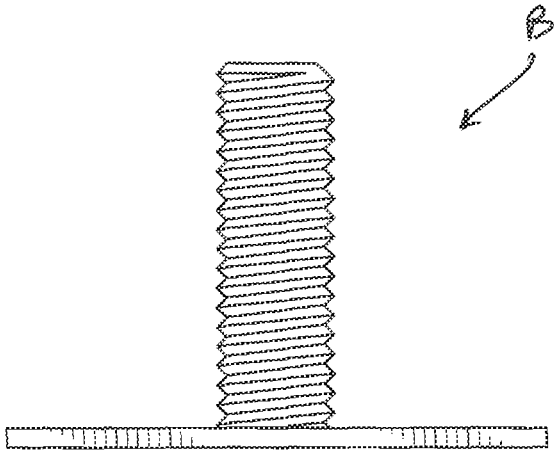
FIG. 6 is a side elevational view illustrating the leg peg.

There is one to each side of the corner centered on the body at 60½" up from the bottom. Small spikes, referred to as Tie Pins, protrude from the body of the Masonry Corner Jig. They are 2" from the corner and are set at 3, 8, 12, 16, 18, 21, 24, 27, 30, 32, 36, 40, 42, 45, 48, 52, 54, 56, 60, 64, 66, 69, 72, 75, 78, 80, 84, 88, 90, 92, 93, and 96 inches from the bottom. Each of the spikes is angled away from the corner. Referring to FIGS. 5 and 6, on the outside of the body, the two Leg Pegs (Part B) is attached using 8 screws, 8 lock washers and 8 nuts at the heights of 47" and 49" at both 3½" and 1½" spacing from the corners. The screws are inserted through the holes from the inside of the body. The Leg Peg is a plate 3" tall and 3" wide with a ⅝ threaded peg protruding from the center. It has 4 holes through it spaced at ½" from each side.

Figure 7:
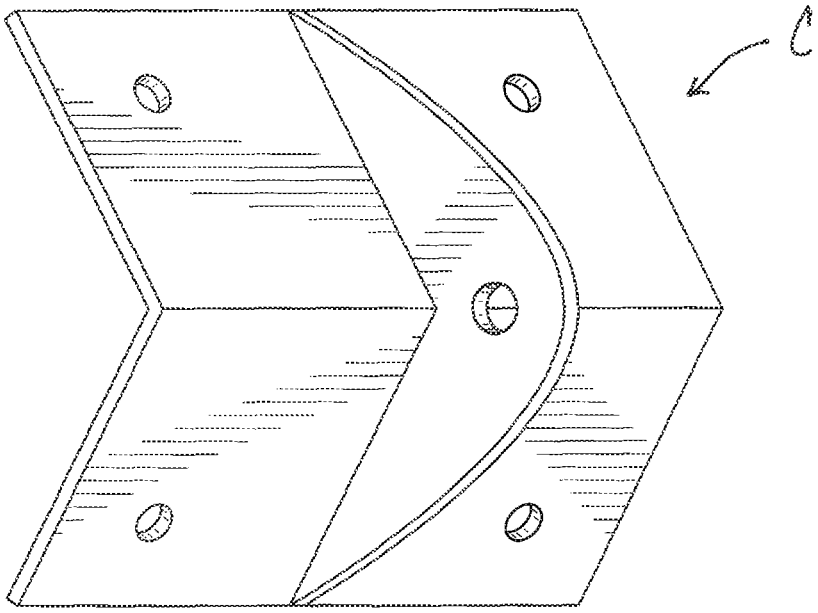
FIG. 7 is a perspective view illustrating the central leg bracket.
Figure 8:
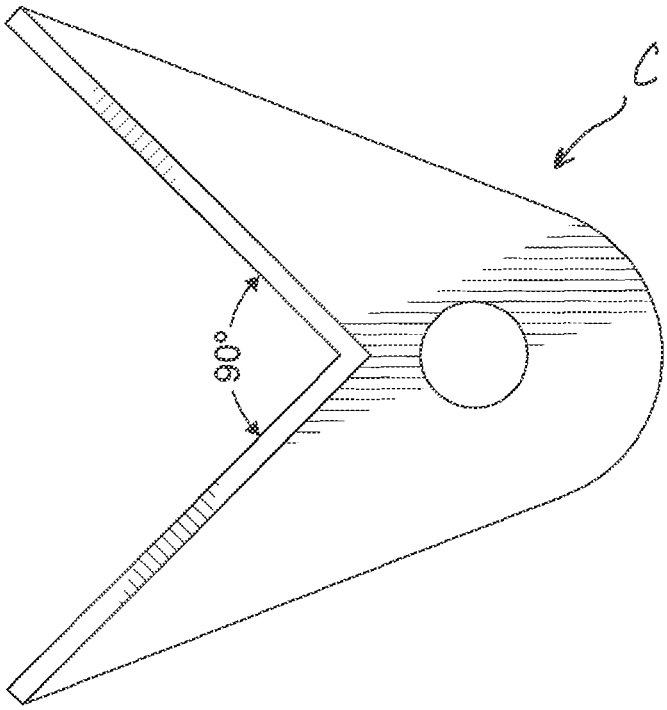
FIG. 8 is a top plan view illustrating the central leg bracket.
Figure 9:
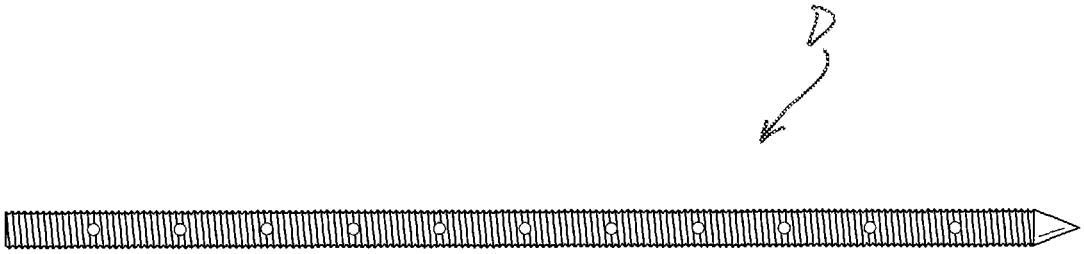
FIG. 9 is a side elevational view illustrating the adjustable grade stake.

Referring specifically to FIGS. 7 and 8, the Central Leg Bracket (Part C) is a 3" tall plate that is bent on a 90-degree angle. Each side extends 2" past the corner. The Central Leg Bracket has four bolt holes in it, one in each of the four corners ½" from each side of the plate. The 2 holes on top are ½" from the top and the 2 holes on bottom are ½" from the bottom. Another plate protrudes from the Central Leg Bracket 2" from the point on the exterior side of the angle. The second plate is in the center of the L shaped plate, from end to end, and curves around a hole that is 11/16" wide and ½" from the corner. The Central Leg Bracket connects to the body by being screwed onto it using the holes at the heights of 4" and 6" for the first Central Leg Bracket and the heights of 9" and 11" for the second one. In each bracket 4 screws are inserted from the inside of the body and are fastened using 1 lock washer and 1 nut per screw.

Referring to FIG. 8, the Adjustable Grade Stake (Part D) is a 2' long rod that is threaded for a nut. It has holes through it starting 1" from the bottom and spaced 2" on center thereafter. The Adjustable Grade Stake is slid through the 11/16" hole on the Central Leg Bracket. A nut is above and below the 11/16" hole on each Central Leg Bracket.

Figure 10:
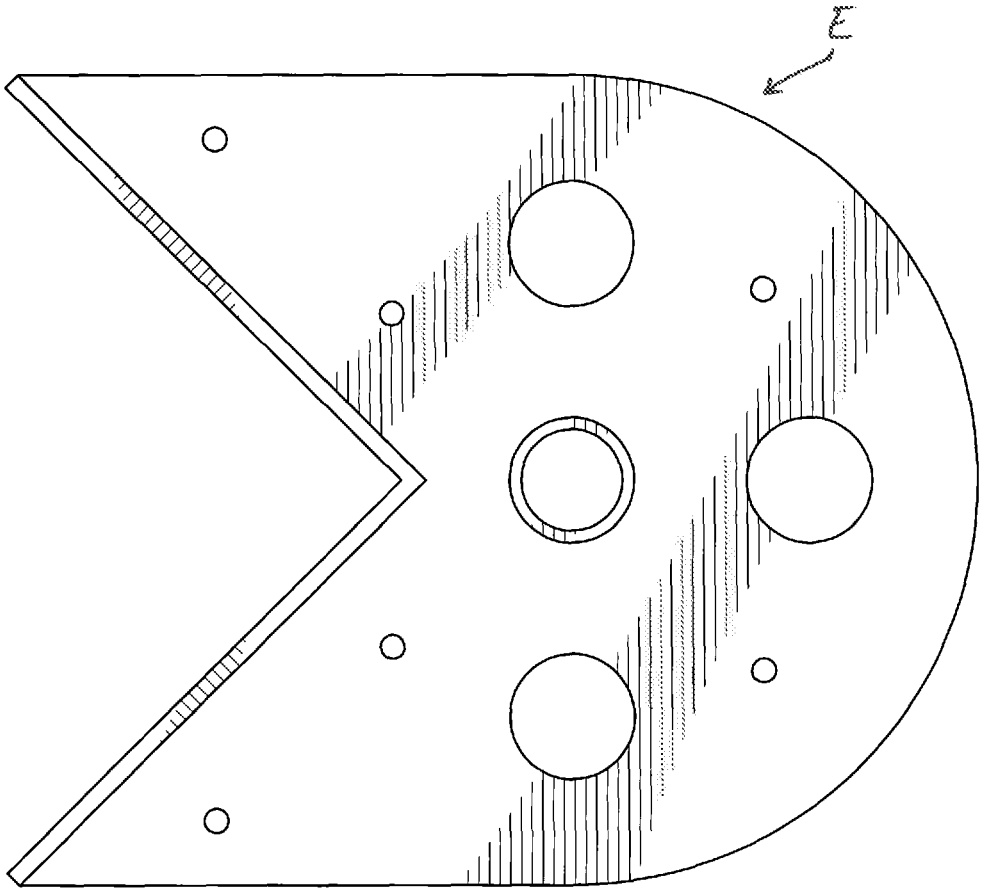
FIG. 10 is a top plan view illustrating the base plate.
Figure 11:
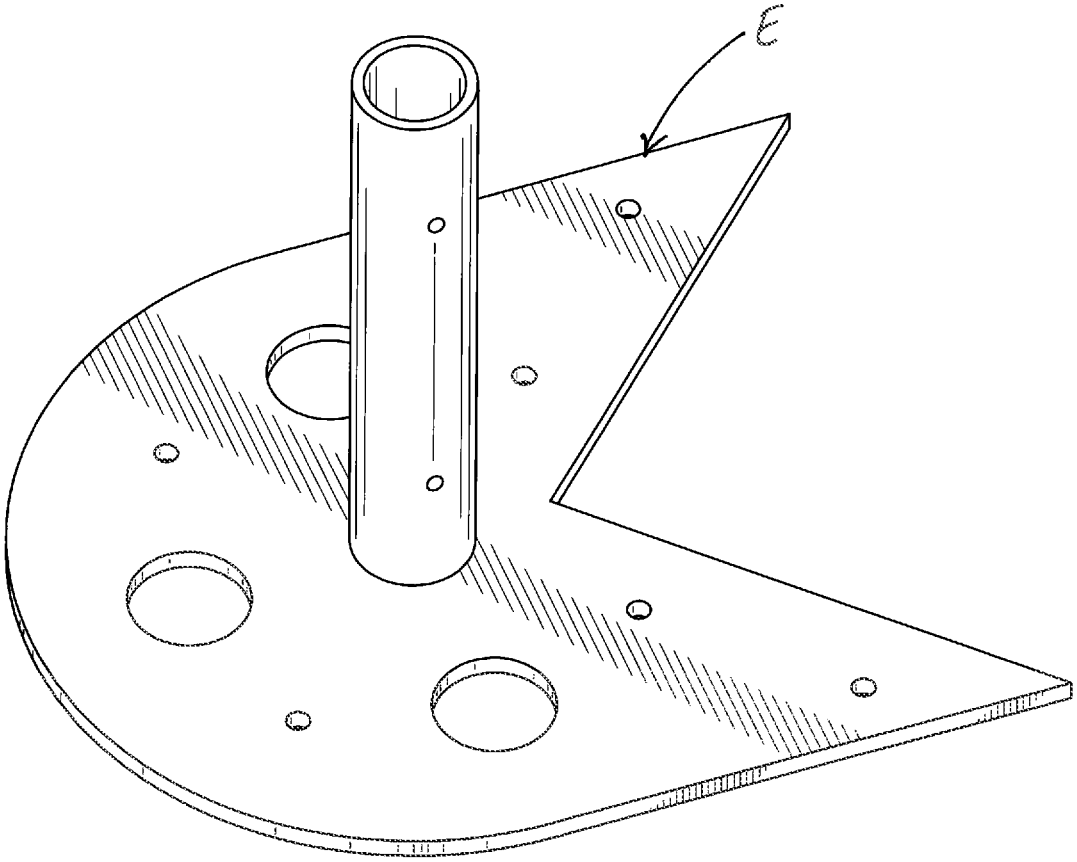
FIG. 11 is a perspective view illustrating the base plate.

Referring to FIGS. 10 and 11, the Base (Part E) is a metal plate. One end has a 2"×2" right triangle cut out of it. The point on the triangle, that is 90-degrees, points to the center of the Base. The Base extends in an oval shape from the 2 45-degree angles of the cut-out area. There are three ⅝" holes through the base. The first 2 holes are 2½" from the 45-degree angles to the nearest part of the hole and ½" from the side. The third hole is in the center of the plate, ½" from the end that is furthest from the 90-degree angle. There are 6 3/16" holes through the plate. Two are parallel to the side that goes from the 45-degree angle to the 90-degree angle on the cut-out side. The first is ¾" from the point of the 45-degree angle, and the second is 1" on center from the first. Both are ½" from the side of the plate. The second two are on the other side parallel to the first two. The remaining two holes are between the ¾" holes ½' from the edge of the plate. A female threaded tube is welded onto the Base with the inside of the tube nearest the 90-degree angle is ½" from the 90-degree angle. The Adjustable Grade Stake screws into this tube connecting the Base to the Body of the Masonry Corner Jig.

Figure 12:
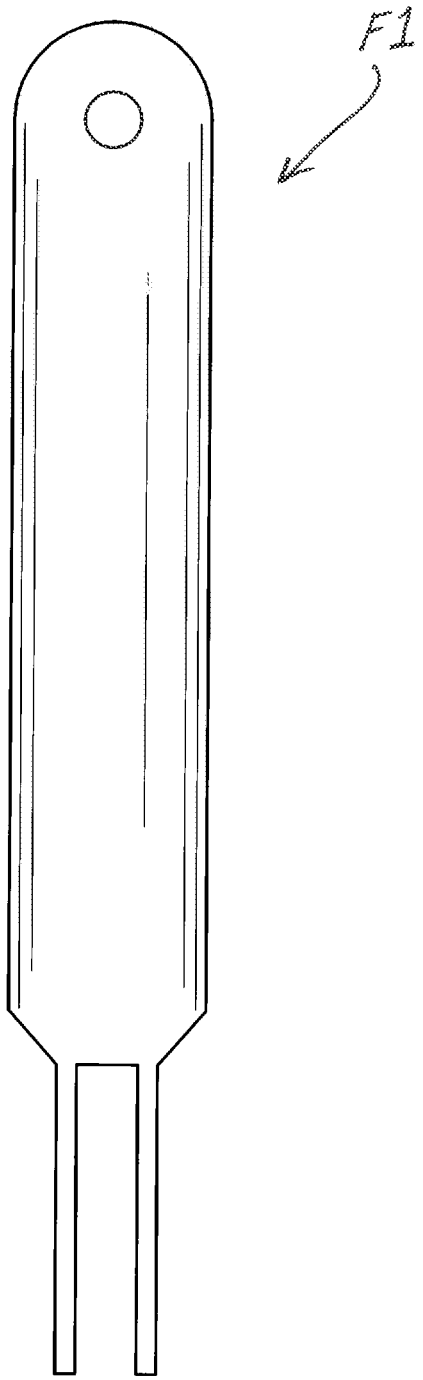
FIG. 12 is a side elevational view of the leg hinge.

Referring to FIGS. 12-16, the Leg consists of parts F1, F2, F4, F4 and F5. Referring to FIG. 12, the Leg Hinge (F1) is 12" in total length. It is a metal tube that is roughly 1½" wide and 8" long with a 2" plate extending from each end. The plates are 1½" wide and the ends are rounded. The plates on the top side (side A) have a ¾" hole in each one that is ½" from the end of the plate. The plates on side A are 1" apart. The plates on the bottom side of the Leg Hinge (side B) are ½" apart. One plate has a square hole that is ½" by ½" and ½" from the end of the plate to the nearest side of the hole. The other plate has a ¼" hole that is ⅜" from the end of the plate to the start of the hole. To connect the Leg Hinge to the Leg Peg first screw a nut onto the threaded peg on the Leg Peg. Slide a flat washer beside the nut. Follow that with a 1¼" female threaded tube screwed on tight against the nut and washer. Slide a flat washer over the threaded tube. A spacer Tube with an inside diameter of 1¼" fits between the holes on side A of the Leg Hinge. Slide the holes on side A over the threaded tube on the Leg Peg. Make sure that the square hole on side B faces toward the Body of the Masonry Corner Jig. Slide a flat washer over the threaded tube on the Leg Peg. Follow this with a washer over the Leg Peg and screw on a nut to hold it all in place.

Figure 14:
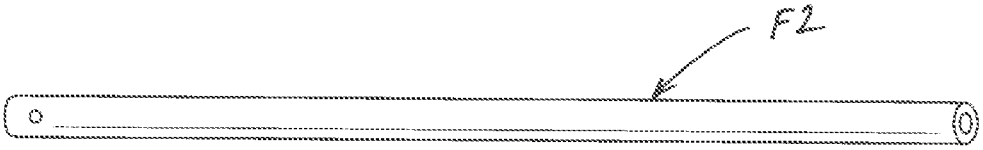
FIG. 14 is a side elevational view illustrating the leg rod.

Referring to FIG. 14, the Leg Rod (Part F2) is a 2' long tube that is 1½" diameter. One end of the tube (Side A) has a ¼" hole through it that is ¾" from the end of the tube. The other end of the tube (Side B) is left hand female threaded to match a ⅝" bolt. The Leg Rod connects to the Leg Hinge by lining the holes on Side A of the Leg Rod with the holes in Side B on the Leg Hinge. The sliding a bolt through both parts and screwing a bolt, that has a square below the head that matches the square hole on Side B of the Leg Hinge, through both parts and screwing a nut onto the bolt to hold it in place.

Figure 13:
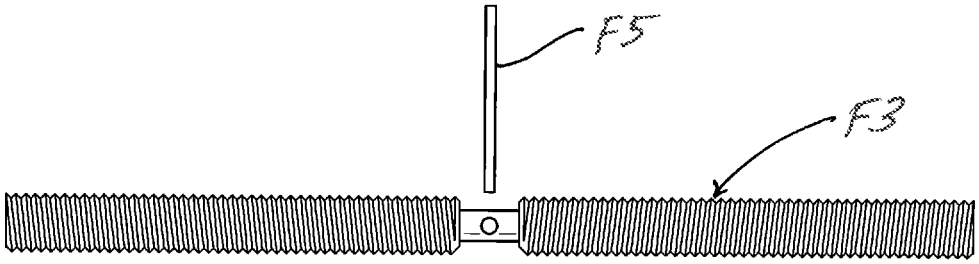
FIG. 13 is a side elevational view illustrating the adjusting rod and the adjusting pin.

Referring to FIG. 13, the Adjusting Rod (Part F3) is a ⅝" by 2' long metal rod. It has a ¼" hole through the center of it 1' from each end. A ¼" by 4" rod the Adjusting Pin (Part F5) is ran through the ¼" hole. The ends of the Adjusting Pin are flared after it is inserted through the hole to ensure it doesn't fall out. The Adjusting Rod is threaded differently on each side of the Adjusting Pin. Side A has a left handed thread and Side B has a right handed thread. Side A of the Adjusting Rod screws into Side B of the Leg Rod. Side B of the Adjusting Rod screws into Side A of the Ankle Rod (Part F4).

Figure 15:
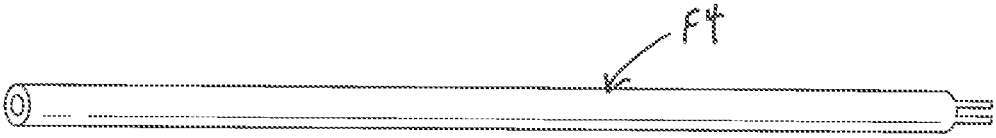
FIG. 15 is a side elevational view illustrating the ankle rod.
Figure 16:
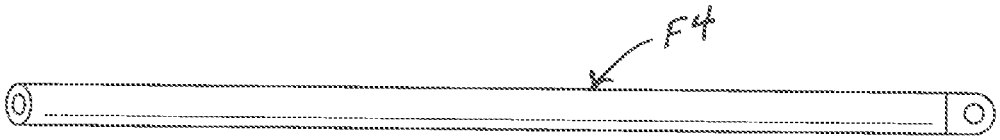
FIG. 16 is a top plan view illustrating the ankle rod.

Referring to FIGS. 15 and 16, the Ankle Rod (Part F4) is a 2' long cylinder. Side A is female threaded to match the right hand thread of the Adjusting Rod. The other end of the Ankle Rod (Side B) has 2" plates extending past the cylinder. The Plates are spaced ½" apart from inside of the plate to the inside of the other plate. One plate has a square hole that measures ½" by ½". The start of the square is ¼" from the end of the plate. The other plate has a ¼" hole through it that is ½" from the end of the plate.

Figure 17:
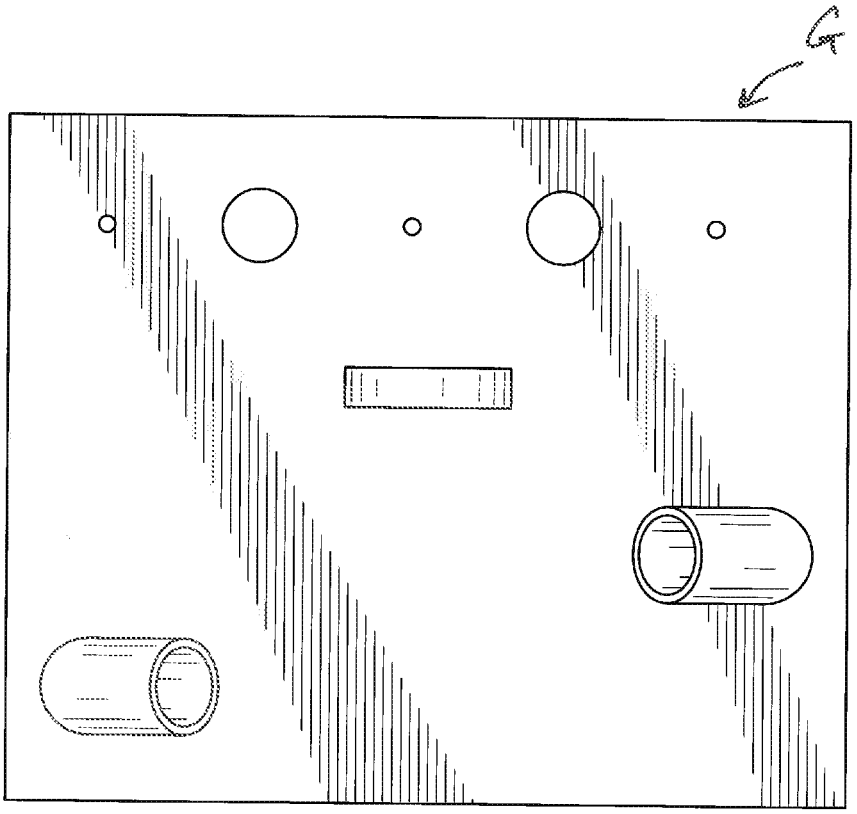
FIG. 17 is a top plan view illustrating the foot plate.
Figure 18:
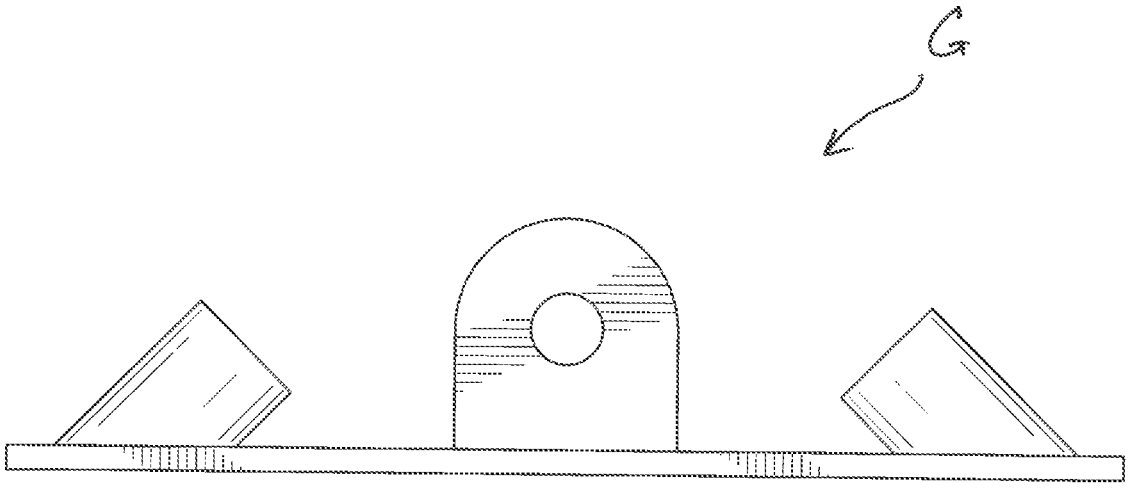
FIG. 18 is a side elevational view illustrating the foot plate.

Referring to FIGS. 17 and 18, the Foot Plate (Part G) is a 5" by 6" plate. The Ankle Bracket is a plate that runs parallel with the 6" sides of the plate. It is 2½" inches from Side A. The Ankle Bracket is a ½" wide, 2" long and 1½" tall plate that are rounded on the top. It has a ¼" hole running through it ½" from the top of the plate. On one of the 6" sides of the plate (Side A) are 5 holes ¾" from the side to the center of each hole. Three of the holes are ⅛" wide. One is in the center and the other 2 are 1" from each end of the plate. Centered between the ⅛" holes are two ⅝" holes, one between the first two and one between the second two ⅛" holes. On the other 6" side of the Foot Plate (Side B) there are two tubes referred to as Grade Stake Guides. Each tube is ½" from the end of the plate and extends 1½" toward the center of the plate on a 45-degree angle. The inside diameter is ¾". A hole is in the plate that matches the tubes inside diameter so that the hole of the tubes extends through the plate. One of the Grade Stake Guides is ½" from the edge of Side B to the nearest edge of the tube, the other is 2¼" from the edge to the nearest part of the tube. The Ankle Bracket connects to the Ankle Rod. A bolt is run through hole in the Ankle Bracket and the hole in Side B of the Ankle Rod.

Instructions for use: Cinder Blocks

On a Monolithic Slab:

If the Form Boards are Still in Place:

Step 1: Align the Masonry Corner Jig so that the inside of the body is flush with the corner of the concrete. Screw 4 self-tapping wood screws into the four holes nearest the concrete on the Base. Adjust the height of the body by turning the bottom nuts directly below the two Central Leg Brackets. When the line at 8" is 8" off the concrete slab, tighten down the two nuts that are directly above the two Central Leg Brackets.

Step 2: Extend the two legs out from the body and attach them to the wooden forms on each side of the body by screwing self-tapping wood screws into the three small holes on the Foot Plate. Make sure the Foot Plate does not stick over the concrete.

Step 3: Check the leveling vial to see if the body is level. If not turn the Adjusting Pin in the proper direction until the bubble on the Leveling Vial is centered between the 2 lines. Setup three more Concrete Masonry Jigs on the remaining corners.

Step 4: From the 8" mark, run masonry string through the hole on the body and fasten it to the Tie Pin on the back of the body. Run it through the groove on the inside of the body to the next Corner Masonry Jig. Run the string through the hole on the inside of the Body as close to the 8" mark as possible and tie it to the Tie Pin on the back side of the body making sure the string is pulled tight. Repeat this process for each wall to be laid and for each additional course. Each string should be set on multiples of 8".

If the Form Boards have been Removed:

Step 1: Align the inside of the Body of the Masonry Corner Jig with the outside corner of the concrete slab. Extend the Base until it sets on solid ground. Drive concrete grade stakes into the holes on the Base. Raise the Body of the Masonry CornerJig until the groove on the inside of the body that is at 8" is separate from the concrete slab (e.g., 8'). Raise the body by turning the 2 nuts that are directly below the Central Leg Bracket. When the desired height is reached, tighten down the 2 nuts directly above the 2 Corner Brackets.

Step 2: Extend the two legs out from the body on roughly a 45-degree angle being sure the Foot Plate sets on solid dirt. Drive concrete grade stakes through the 2 tubes on the Foot Plate to secure the Foot Plate in place.

Step 3: Check the leveling vial to see if the body is level. If not turn the Adjusting Pin in the proper direction until the bubble on the Leveling Vial is centered between the 2 lines. Setup three more Concrete Masonry Jigs on the remaining corners.

Step 4: From the 8" mark, run masonry string through the hole on the body and fasten it to the Tie Pin on the back of the body. Run it through the groove on the inside of the body to the next Corner Masonry Jig. Run the string through the hole on the inside of the Body as close to the 8" mark as possible and tie it to the Tie Pin on the back side of the body making sure the string is pulled tight. Repeat this process for each wall to be laid and for each additional course. Each string should be set on multiples of 8".

On a Footer:

Step 1: Find the corner of the wall to be built. Align the inside of the Corner Masonry Jig body with the outside of the corner of the wall to be built. On the Masonry Corner Jig Base, predrill holes into the concrete, through the small holes on the Masonry Corner Jig Base and screw in masonry screws into the holes.

Step 2: If setting the Foot Plate in dirt, follow steps 2 through 4 in section with form boards removed.

If setting the Foot Plate on the footer: Extend the Legs out away from the body on roughly a 45-degree angle and set them on the footer outside the line of the wall. On the Foot Plate, predrill holes into the 3 small holes on the Footer and screw in masonry screws into the holes to secure the Foot Plate in place. The 2 larger holes can be used if anchor bolts are preferred. If using anchor bolts, predrill holes for the anchor bolts through the 2 large holes on the Foot Plate and follow manufacturer's instructions to install bolts.

Step 3: Check the leveling vial to see if the body is level. If not turn the Adjusting Pin in the proper direction until the bubble on the Leveling Vial is centered between the 2 lines. Setup three more Concrete Masonry Jigs on the remaining corners.

Step 4: From the 8" mark, run masonry string through the hole on the body and fasten it to the Tie Pin on the back of the body. Run it through the groove on the inside of the body to the next Corner Masonry Jig. Run the string through the hole on the inside of the body as close to the 8" mark as possible and tie it to the Tie Pin on the back side of the body making sure the string is pulled tight. Repeat this process for each wall to be laid and for each additional course. Each string should be set on multiples of 8".

While the present invention has been shown and described in accordance with several preferred and practical embodiments, it is recognized that departures from the instant disclosure are contemplated within the spirit and scope of the present invention.

What is claimed is:

1. A masonry corner jig comprising:

a main elongate body including first and second portions extending from a midpoint, the main elongate body forming a plurality of apertures extending a length of the main elongate body at the midpoint;

first and second leg pegs each being sized and configured for selective attachment to the main elongate body on a respective one of the first and second portions;

first and second L-shaped plates each defining a central leg bracket including a first surface and a second surface; the central leg bracket being sized and configured for selective attachment to the main elongate body; the central leg bracket including a curved plate extending from the second surface, the curved plate forming a hole extending the length of the curved plate;

an adjustable grade stake sized and configured for engaged passage through the hole on each of the curved plates of the respective central leg brackets;

a metal plate defining a base, the base forming a body having a 90-degree cutout section wherein the point of the 90-degree cutout section is aligned with the center of the base; the base forming three holes along a perimeter zone of the base; a tube extending from the base and forming a channel sized for engaged receipt of the adjustable grade stake;

first and second legs each comprising:

a leg hinge having a first end and a second end that is sized and configured for attachment to the leg peg;

a leg rod having a first end and a second end that is sized and configured for attachment to the first end of the leg hinge;

an adjusting rod having a first end and a second end that is sized and configured for attachment to the first end of the leg rod; the adjusting rod having a hole through the center of the adjusting rod;

an adjusting pin that is sized and configured for engaged passage through the hole of the adjusting rod;

a cylinder defining an ankle rod, the ankle rod having a first end and a second end that is sized and configured for attachment to the first end of the adjusting rod; and a foot plate that is sized and configured for attachment to the first end of the ankle rod.

2. The masonry corner jig as recited in claim 1 wherein the first and second portions extend at a 90-degree angle relative to each other from the midpoint.

3. The masonry corner jig as recited in claim 1 wherein the first and second central leg brackets each includes a 90-degree bend.

* * * * *